United States Patent [19]

Porter

[11] Patent Number: 4,947,600

[45] Date of Patent: Aug. 14, 1990

[54] BRICK WALL COVERING

[76] Inventor: William H. Porter, P.O. Box 249, Saugatuck, Mich. 49453

[21] Appl. No.: 355,326

[22] Filed: May 22, 1989

[51] Int. Cl.[5] ..... E04F 13/00

[52] U.S. Cl. ..... 52/235; 52/309.7; 52/315; 52/387; 52/405; 52/410; 52/309.12

[58] Field of Search ..... 52/384–390, 52/309.12, 315, 385, 374, 309.11, 410, 235, 408, 387, 283, 309.7, 309.15, 405

[56] References Cited

U.S. PATENT DOCUMENTS

| | | | |
|---|---|---|---|
| 800,655 | 10/1905 | Kitsee . | |
| 830,313 | 9/1906 | Fenn . | |
| 874,909 | 12/1907 | Fischer . | |
| 1,850,961 | 3/1932 | Mortenson . | |
| 1,861,359 | 5/1932 | Pyron . | |
| 1,946,690 | 2/1934 | Haines . | |
| 1,994,644 | 3/1935 | Harshberger . | |
| 2,005,380 | 6/1935 | Marsh et al. . | |
| 2,043,706 | 6/1936 | Myers . | |
| 2,054,573 | 9/1936 | Mendenhall . | |
| 2,078,069 | 4/1937 | Eliel | 52/283 |
| 2,114,451 | 4/1938 | Mattes | 52/385 |
| 2,202,568 | 5/1940 | Worden . | |
| 3,270,473 | 9/1966 | Smith . | |
| 3,353,315 | 11/1967 | Barker | 52/275 |
| 3,387,422 | 6/1968 | Wanzer . | |
| 3,533,206 | 10/1970 | Passeno | 52/387 |
| 3,740,911 | 6/1973 | O'Leary . | |
| 3,868,801 | 3/1975 | Weiner | 52/315 |
| 3,962,504 | 6/1976 | Sherwin . | |
| 4,589,241 | 5/1986 | Volpenhein | 52/315 |
| 4,619,090 | 10/1986 | McManus | 52/283 |
| 4,662,140 | 5/1987 | Porter et al. . | |

*Primary Examiner*—John E. Murtagh
*Attorney, Agent, or Firm*—Emrich & Dithmar

[57] ABSTRACT

A foam plastic sheet attached to a primary wall, or substructure, is provided with a plurality of spaced, linear, parallel slots in its outer surface. Also securely attached to the primary wall adjacent to a lower edge of the plastic sheet are a plurality of spaced gussets for supporting an L-shaped ledge angle which is also mounted to the wall and extends the length of the plastic sheet. The ledge angle extends outwardly from the wall and includes a return flange on the distal end thereof. A grout adhesive layer is applied to the outer surface of the plastic board followed by insertion of an elongated support/spacer strip into each of the slots therein. Each strip is provided with a plurality of spaced, generally pointed tabs extending outward from the plastic sheet and through the layer of grout. A high strength fabric mesh is pressed into the grout such that the tabs extend through apertures in the mesh. The tabs ensure proper spacing and provide support for bricks pushed into and attached to the grout, with the ledge angle engaging and providing support for a bottom row of bricks. Grout, or mortar, is applied between the thus positioned bricks.

24 Claims, 1 Drawing Sheet

BRICK WALL COVERING

BACKGROUND OF THE INVENTION

This invention relates generally to building materials and structures and is particularly directed to a brick wall covering for a primary wall, or substructure.

Face brick structures are used in building construction to improve appearance and enhance durability. Prior art face brick structures typically include a sheet metal lath attached to a wall to be covered by the face brick. An example of this approach is disclosed and claimed in U.S. Pat. No. 4,662,140 to Porter et al.

The brick support structure should afford a high degree of bonding to the bricks for structural integrity. The sheet metal panels used in the prior art afford only limited bonding because of the smoothness of the bonding surface and the limited adherence of a layer of paint frequently applied thereto. These prior art sheet metal panels not only typically offer limited bonding to the outer thin brick surface, but also are expensive. The extent of bonding is further limited by tabs extending outward from the sheet metal panel which cause the non-uniform application of grout to which the bricks are bonded on the outer surface of the sheet metal panel. The non-uniform application of the grout due to the presence of these outward extending tabs causes voids in the grout layer. These voids can collect water which, as a result of freezing/thawing cycles, loosen the brick and mortar outer layer on the sheet metal panel and also over time generally result in corrosion of the sheet metal panel and deterioration of other metal components in the wall construction.

These prior art sheet metal based brick support structures also do not generally tie together large areas of the brick veneer resulting in the random propagation of expansion cracks in the brick structure. In addition, relative movement between the primary wall and the outer brick veneer securely mounted thereto produces large compression and expansion forces in the brick veneer leading to the further propagation of cracks in its structure. These cracks lead eventually to the disintegration of the brick veneer necessitating extensive repairs or replacement.

The present invention addresses the aforementioned limitations of the prior art by providing a brick wall covering and attachment means therefor which provides a high degree of bonding between the bricks and underlying substructure, facilitates the application of a brick adhering grout so as to provide a uniform, continuous bonding layer for the bricks, and allows for direct coupling between the brick support structure and the substructure for improved brick support and attachment.

OBJECTS AND SUMMARY OF THE INVENTION

Accordingly, it is an objection of the present invention to provide an improved arrangement for attaching brick veneer to a wall.

It is another object of the present invention to provide a low cost, insulated mounting arrangement for affixing bricks to the surface of a wall.

Yet another object of the present invention is to provide structure for attaching brick veneer to a wall which affords high strength support for the bricks and ensures proper spacing and alignment of adjacent rows of bricks.

A further objeet of the present invention is to improve the attachment of a face brick structure to a wall by means of a high strength fabric mesh embedded in a grout layer to which the bricks adhere.

A still further object of the present invention is to provide expansion joints in brick veneer at designated locations for preventing the random propagation of expansion joints therein by forming the brick veneer in a monolithic structure using a fabric mesh disposed within a brick supporting grout/mastic.

Another object of the present invention is to provide a well insulated brick veneer support structure which facilitates attachment of bricks to a substructure and which is not subject to corrosion or water damage.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
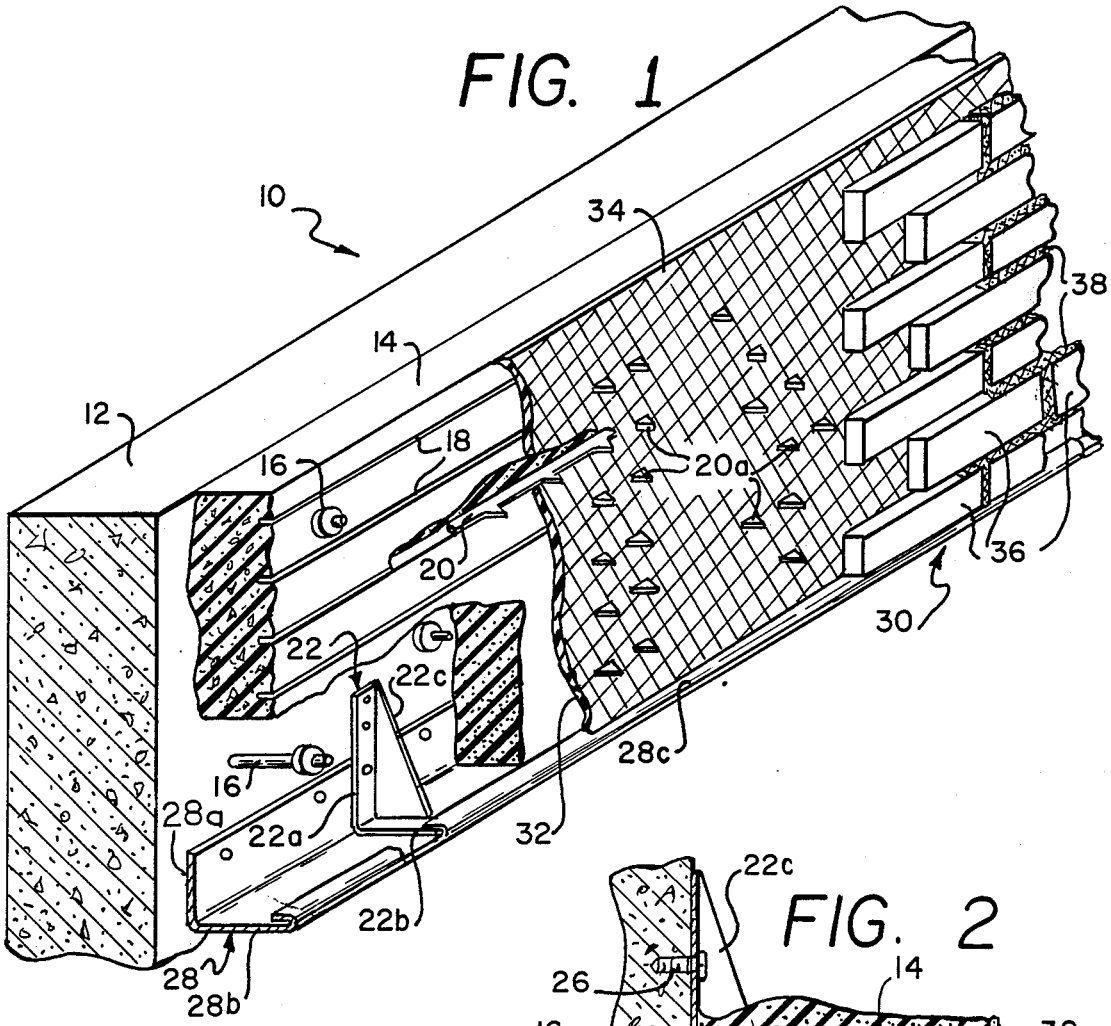
FIG. 1 is a partially cutaway combined perspective and sectional view of a brick wall covering and means for attachment thereof to a primary wall.

Referring to FIG. 1, there is shown a combination perspective and sectional view shown partially cutaway of a brick mounting arrangement 10 for securely attaching a plurality of bricks 30, commonly termed a brick veneer, to a primary wall 12. The term primary wall is intended to include a base structure, or substructure, or virtually any structure to which a brick veneer may be mounted.

The primary wall 12 is generally comprised of concrete, but may be formed of other conventional building materials such as wood or masonry. The brick veneer 30 is comprised of a plurality of generally rectangular bricks 36 positioned in mutual, spaced alignment as shown in the figure. A conventional filler material such as grout 38 is positioned in the inter-brick space to prevent the entry of water into the wall-brick veneer space within which the brick mounting arrangement 10 of the present invention is positioned. The individual bricks 36 are generally thin so as to provide the primary wall 12 with an attractive, durable outer surface and do not generally provide a support function.

Figure 2:
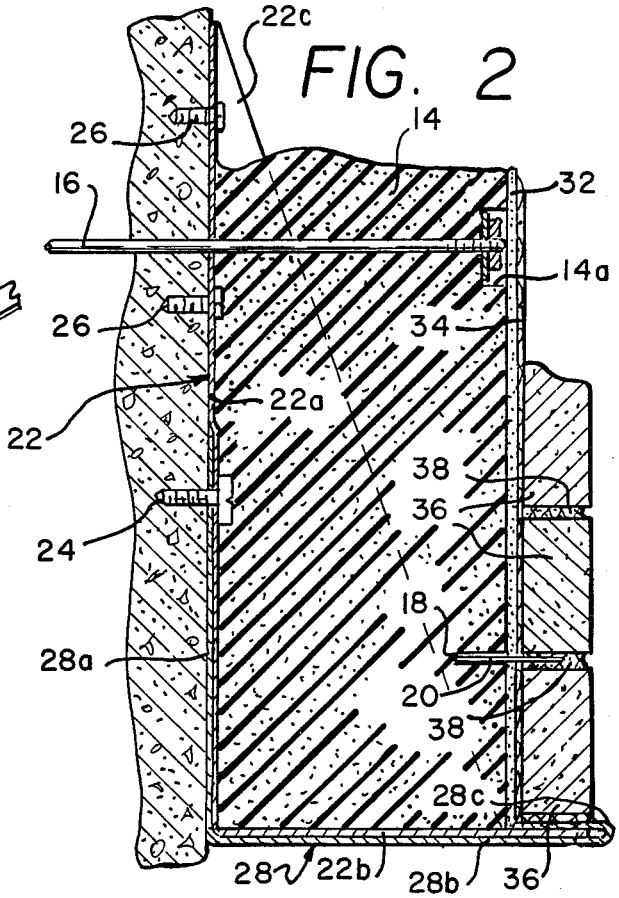
FIG. 2 is a sectional view of a portion of the brick wall covering and mounting arrangement shown in FIG. 1 illustrating details of the manner in which the bricks are supported by and attached to a primary wall.

Referring to FIG. 1 as well as to FIG. 2, which is a sectional view of a portion of FIG. 1, the brick mounting arrangement 10 includes a foam plastic sheet, or board, 14 mounted to a surface of the primary wall 12 by conventional attachment means such as a plurality of mounting pins 16. Each of the mounting pins 16 may be attached to the primary wall 12 by means of a nut in a conventional manner or may threadably engage the primary wall in a screw-like manner. The head of each mounting pin 16 is counter sunk within a recessed portion 14*a* of the foam plastic sheet 14 such that the outer, or distal, surface of the foam plastic sheet 14 is generally planar. Also disposed on the outer surface of the foam plastic sheet 14 in a vertically spaced array are a plurality of alignment slots 20. Each of the alignment slots 20 extends substantially the full length of the foam plastic sheet 14 and is in the form of an elongated, linear recess in the foam plastic sheet's outer surface. While generally planar, the outer surface of the foam plastic sheet 14, which is preferably comprised of polystyrene, is generally rough textured. The foam plastic sheet 14 provides a high degree of insulation between the primary wall 12 and the brick veneer 30.

Also securely attached to the surface of the primary wall 12 is a brick ledge angle 28 positioned along and in contact with a lower edge of the foam plastic sheet 14. The brick ledge angle 28 is generally L-shaped and includes a first mounting portion 28*a*, a second support portion 28*b*, and a turned back edge, or retaining flange, 28*c*. The first mounting and second support portions 28*a*, 28*b* of the ledge angle 28 are oriented generally transverse to each other, with the retaining flange 28*c* disposed on the distal end of the angle's support portion. The retaining flange 28*c* is formed by bending the distal edge of the support portion 28*b* upward and inward so as to extend toward the primary wall 12. The ledge angle 28 is securely attached to the primary wall 12 by means of a plurality of spaced, threaded mounting pins 24 inserted through the ledge angle and into the primary wall. From the figures, it can be seen that the ledge angle 28 must be positioned upon and affixed to the primary wall 12 prior to mounting of the foam plastic sheet 14. The ledge angle 28 extends substantially the entire length of the foam plastic sheet 14 and is preferably comprised of a high strength, weather resistant material such as of steel or plastic, or may be in the form of a piece of masonry extending from the foundation of the building of which the primary wall 12 forms a part. The foam plastic sheet 14 provides support for the brick veneer 30, although the additional support provided by the ledge angle 28 as described below is also frequently required.

Also attached to the primary wall 12 by means of a plurality of threaded mounting pins 26 is a triangular support gusset 22. The support gusset 22 includes a mounting portion 22*a*, a support portion 22*b*, and a triangular portion 22*c* coupled to and extending between the mounting and support portions. The support portion 22*b* of the support gusset 22 is positioned in contact with the support portion 28*b* of the ledge angle 28 such that the distal end of the gusset's support portion is inserted in tight fitting relation within the retaining flange 28*c* in the ledge angle. The mounting portion 22*a* of the support gusset 22 is securely attached to the primary wall 12 by means of the aforementioned threaded mounting pins 26. The intermediate triangular portion 22*c* connecting the mounting and support portions 22*a*, 22*b* of the support gusset 22 substantially increases the strength of the gusset and adds substantial support to the ledge angle 28 for supporting large sections of the brick veneer 30. During assembly of the brick mounting arrangement 10, properly spaced slots (not shown) may be incorporated in the lower, aft edge of the foam plastic sheet 14 by conventional means such as cutting or by the application of a heated element. These slots are adapted to receive the triangular portion 22*c* of a respective one of the support gussets 22 and permit the foam plastic sheet 14 to be mounted in closely spaced relation to the surface of the primary wall 12.

With the combination of a brick ledge angle 28 and a plurality of support gussets 22 as well as the foam plastic sheet 14 firmly mounted to the primary wall 12, grout 32, such as in the form of a latex adhesive is applied to the entire outer surface of the foam plastic sheet. The adhesive grout 32 is preferably applied with a serrated trowel to a thickness of approximately 3/32', leaving a series of generally vertically aligned, spaced, parallel serrations in the outer surface of the grout as shown in FIG. 1. The adhesive grout 32 is easily spread over the generally flat, roughened outer surface of the foam plastic sheet 14. Prior art approaches have involve the spreading of a grout over a thin metal sheet having a large number of spaced tabs extending therefrom. Attempts to spread the grout over the outer surface of the metal sheet to form a uniform, continuous layer have led to the formation of voids and other irregularities in the thus deposited grout. These voids not only reduce the adhering force applied on the individual bricks, but also allow water to collect within the brick mounting structure 10. Repetitive freeze/thaw cycles of this water trapped within the wall inevitably result in deterioration of the brick veneer as evidenced by the propagation of cracks and the loss of grout in the interbrick spacing. The present invention provides a substantially flat surface over which the adhesive grout 32 is applied and essentially eliminates voids and other irregularities in the thus applied grout.

Figure 3:
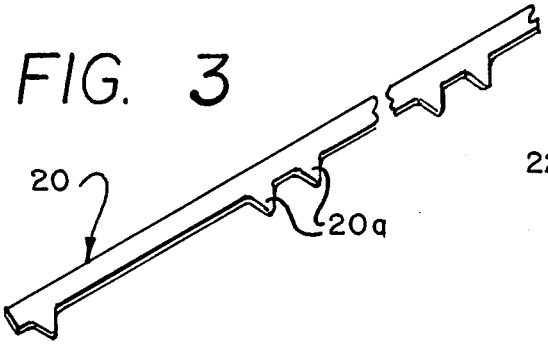
FIG. 3 is a perspective view of a strip used in aligning and supporting face bricks in the brick wall covering arrangement of the present invention.

Following application of the grout 32 to the outer surface of the foam plastic sheet 14, a spacing/support strip 20, as shown in FIG. 3, is inserted within each of the elongated, linear slots 18 on the outer surface of the foam plastic sheet. A strip 20 may be inserted into a respective slot 18 within the outer surface of the foam plastic sheet 14 covered by the grout 32 by lining up respective ends of a strip and slot and inserting the strip through the grout into the slot. The strip 20 is preferably comprised of a high strength, corrosion resistant material such as steel or plastic. Disposed along the length of the strip 20 in a spaced manner are a plurality of projections, or teeth, 20*a*. Each of the projections 20*a* extends outward from its associated slot 18 in the foam plastic sheet 14 and through the layer of grout 32. The projections 20*a* are arranged in generally horizontal, linear, spaced arrays so as to be positioned between immediately adjacent upper and lower bricks and provide support for the former as it is positioned upon and in contact with the layer of grout 32. By extending through the grout layer 32, the strip projections 20*a* also facilitate positioning of the bricks 36 in an aligned, parallel manner and ensure that uniform spacing is maintained between adjacent bricks.

Following application of the layer of grout 32 upon the outer surface of the foam plastic sheet 14, a mesh 34 comprised of a high strength fabric is positioned upon and embedded in the grout. With the fabric mesh 34 embedded within the grout 32, as the grout cures the grout/mesh combination forms a thin, high strength, unitary structure covering a large surface area. The pointed distal ends of the projections 20*a* permit the fabric mesh 34 to be positioned over and embedded in the underlying layer of grout without cutting or tearing the mesh material. The mesh 34 may be comprised of any of the more conventional, high strength materials such as nylon or may be comprised of interconnected metal strands. The mesh 34 preferably covers two or more adjacent foam plastic sheets so as to provide secure coupling therebetween. This prevents the formation of expansion joints in a random manner within the brick veneer 30. By connecting adjacent foam plastic sheets 14 by means of the mesh 34, expansion joints in the brick veneer 30 form in regular patterns and in a predictable manner between adjacent mesh connected sections of the underlying foam plastic sheets. In a preferred embodiment, the mesh 34 ties together adjacent foam plastic sheets up to on the order of 20 feet in length.

After the mesh 34 has been pressed into the latex grout 32 and while the grout is curing, the bricks 36 are pressed into contact with the grout in linear, spaced arrays as shown in the figures. An outer grout 38 is then inserted between adjacent bricks 36 in order to provide support for the bricks and to seal the inner supporting portion of the wall from the elements. With the bricks 36 positioned in contact with the grout 32, the bricks are arranged in a vertically stacked array above the retaining flange **28*c* of the ledge angle 28 as shown in FIG. 2. The retaining flange 28*c* thus provides support for the array of bricks 36 disposed thereabove. The doubled-over configuration of the retaining flange 28*c* not only provides a means for securely engaging a distal edge of the support gusset 22, but also provides increased support strength for the bricks 36. The curved distal edge of the retaining flange 28*c* prevents moisture from entering the internal structure of the brick mounting arrangement 10**.

The foam plastic sheet 14 allows for relative movement between the brick veneer 30 and the primary wall 12. Relative movement between the brick veneer 30 and the primary wall 12 is taken up, or accommodated, by the foam plastic sheet 14. By allowing a limited amount of relative displacement between the primary wall 12 and the brick veneer 30, movement of one structure relative to the other such as due to thermal expansion, structural shifts, or foundation settling is accommodated without damage to either the brick veneer or the primary wall.

There has thus been shown an improved brick wall cover and support structure therefor which affords stronger brick adhesion to the building's primary wall, improved support for the brick veneer, a low cost, insulated structure which is easily assembled, and a more durable brick veneer arrangement which is less susceptible to expansion cracking and water damage. The brick wall covering of the present invention makes use of a foam plastic sheet as an insulated backing for the brick veneer. Attached to the primary wall adjacent to a lower edge of the foam plastic sheet is a brick ledge angle with a plurality of associated supporting gussets also attached to the wall for supporting the brick veneer. A mesh comprised of a high strength fabric is embedded in a layer of adhesive grout spread over the outer surface of the foam plastic sheet for coupling together two or more adjacent foam plastic sheets in forming large, unitary mounting and support structures for the brick veneer. Expansion joints form between adjacent, coupled sections of the foam plastic sheets such that the formation of expansion joints as randomly propagated cracks in the brick veneer is avoided.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A brick wall covering comprising:

an insulating sheet affixed over an inner surface thereof to a base wall, said insulating sheet having a plurality of spaced, linear slots in an outer surface thereof;

adhesive means disposed over the outer surface of said sheet;

spacer/support means inserted in the slots of said sheet and extending through said adhesive means;

a plurality of bricks engaging said adhesive means and maintained in position thereby, wherein said bricks are positioned between in a spaced manner and supported by said spacer/support means and wherein grout is disposed between adjacent bricks; and support means attached to said base wall adjacent to and in contact with a lower portion of said sheet and a bottom row of bricks for providing support therefor.

2. The brick wall covering of claim 1 wherein said insulating sheet is comprised of foam plastic.

3. The brick wall covering of claim 2 wherein the outer surface of said foam plastic sheet is generally planar and rough textured.

4. The brick wall covering of claim 1 further comprising mounting means for securely affixing said insulating sheet to said base wall.

5. The brick wall covering of claim 4 wherein said mounting means includes a plurality of mounting pins.

6. The brick wall covering of claim 1 wherein said adhesive means comprises an adhesive grout applied as a thin layer to the outer surface of said insulating sheet.

7. The brick wall covering of claim 6 wherein said spacer/support means includes a plurality of elongated, linear strips each inserted through said adhesive grout into a respective slot.

8. The brick wall covering of claim 7 wherein each of said strips includes a plurality of spaced projections disposed along the length thereof and extending through said adhesive grout and positioned between adjacent bricks.

9. The brick wall covering of claim 8 wherein each of said projections has a pointed distal end.

10. The brick wall covering of claim 1 further comprising reinforcing means disposed within said adhesive means for securely coupling two or more adjacent insulating sheets.

11. The brick wall covering of claim 10 wherein said adhesive means comprises an adhesive grout and said reinforcing means comprises a high strength fabric mesh embedded within said adhesive grout.

12. The brick wall covering of claim 11 wherein said spacer/support means includes a plurality of elongated, linear strips each inserted through said adhesive grout and wherein each of said strips includes a plurality of spaced projections extending through said adhesive grout and disposed between adjacent bricks.

13. The brick wall covering of claim 11 wherein each of said strips includes a plurality of spaced projections extending therefrom and wherein said projections extend through said adhesive grout as well as through apertures in said fabric mesh.

14. The brick wall covering of claim 1 wherein said support means includes an elongated, linear ledge angle extending substantially the length of said sheet.

15. The brick wall covering of claim 14 wherein said support means further includes a plurality of support gussets mounted to said base wall and coupled to said ledge angle in a spaced manner along the length thereof.

16. The brick wall covering of claim 15 wherein said ledge angle is generally L-shaped and includes a distal retaining flange for engaging each of said support gussets and engaging and providing support for a bottom row of bricks.

17. The brick wall covering of claim 16 wherein each of said support gussets is generally triangular and includes a distal edge adapted for insertion in and coupling to the retaining flange of said ledge angle.

18. An arrangement for securely attaching bricks to the surface of a substructure, said arrangement comprising:

a sheet of foam plastic insulating material affixed to the surface of a substructure and having a plurality of spaced slots on its outer surface;

adhesive means disposed on an outer surface of said sheet for receiving and bonding to the bricks;

spacer means attached to the outer surface of said sheet and extending through said adhesive means for aligning the bricks in spaced, parallel rows on said sheet, wherein said spacer means includes a plurality of strips each adapted for insertion in an retention by a respective one of said slots; and support means attached to the substructure adjacent to and in engagement with a lower portion of said sheet and a bottom row of bricks so as to provide support therefor.

19. The arrangement of claim 18 wherein each of said strips includes a plurality of spaced teeth thereon, wherein each of said teeth extends through and out of said adhesive means.

20. The arrangement of claim 19 wherein said adhesive means comprises a layer of latex grout disposed on the outer surface of said sheet.

21. The arrangement of claim 20 further comprising coupling means disposed within said latex grout for securely coupling together a plurality of adjacent sheets of insulating material.

22. The arrangement of claim 21 wherein said coupling means includes a high strength mesh-like structure.

23. The arrangement of claim 18 wherein said support means includes an L-shaped ledge angle in combination with at least one support gusset coupled to said ledge angle and to the substructure.

24. A wall construction comprising:

a base wall;

a brick veneer comprised of a plurality of bricks arranged in a spaced, aligned manner;

an insulated sheet disposed between said base wall and said brick veneer and having a plurality of spaced, linear slots in an outer surface thereof;

first means coupling said insulated sheet to said base wall;

second means coupling said brick veneer to said insulated sheet in a manner permitting relative movement between said brick veneer and said base wall, said second means including adhesive means disposed on the outer surface of said insulated sheet for engaging said bricks and spacer/support means disposed in the slots in said insulated sheet for supporting said bricks in a spaced manner on the outer surface of said insulated sheet; and third means coupled to said base wall for providing support for said insulated sheet and said brick veneer.

* * * * *